United States Patent [19]

Slattery

[11] Patent Number: 4,528,954

[45] Date of Patent: Jul. 16, 1985

[54] THROTTLE AND SPARK LINKAGE FOR AN OUTBOARD MOTOR

[75] Inventor: Gordon C. Slattery, Omro, Wis.

[73] Assignee: Brunswick Corporation, Skokie, Ill.

[21] Appl. No.: 566,903

[22] Filed: Dec. 29, 1983

[51] Int. Cl.[3] ..... F02P 5/02

[52] U.S. Cl. ..... 123/413

[58] Field of Search ..... 123/413

[56] References Cited

U.S. PATENT DOCUMENTS

| | | | |
|---|---|---|---|
| 2,890,689 | 6/1959 | Alexander | 123/413 X |
| 3,734,069 | 5/1973 | Akiyama et al. | 123/413 X |
| 3,769,949 | 11/1973 | Elingsen | 123/413 |
| 4,071,002 | 1/1978 | Frahm | 123/413 |
| 4,492,198 | 1/1985 | Okumura | 123/413 |

*Primary Examiner*—Tony M. Argenbright

*Attorney, Agent, or Firm*—Andrus, Sceales, Starke & Sawall

[57] ABSTRACT

Improved throttle and spark advance linkage is suitable for use in a marine drive, such as an outboard motor, having a throttle valve, a throttle operator with a cam follower for opening and closing the throttle valve, means for altering the ignition timing, and maximum and minimum spark advance stops. The linkage includes a spark advance lever pivotally mounted on the marine drive. The spark advance lever is coupled to the means for altering the ignition timing so that the timing is advanced and retarded responsive to the pivotal movement of the spark advance lever. The spark advance lever has means engaging the maximum and minimum spark advance stops for limiting the pivotal movement of the spark advance lever. A throttle lever is pivotally mounted on the marine drive coaxially with the spark advance lever. The spark advance lever and throttle lever have cams coacting with the cam follower on the throttle operator for opening and closing the throttle responsive to pivotal movement of the levers. A coil spring couples the spark advance lever to the throttle lever for obtaining common movement of both levers while permitting independent movement of the throttle lever when the spark advance lever engages one of the stops. The coil spring surrounds the pivot axes of the throttle lever and spark advance lever. The coil spring has ends engaging radially spaced projections on the spark advance lever and throttle lever to obtain the common movement. The resiliency of the spring permits the independent movement.

7 Claims, 5 Drawing Figures

THROTTLE AND SPARK LINKAGE FOR AN OUTBOARD MOTOR

In an internal combustion engine, such as an outboard motor, it is necessary to alter the ignition timing in accordance with the speed of the motor to obtain proper performance. Ignition timing is advanced as the throttle valve is opened to cause the spark to occur earlier in higher speed engine cycles. The spark is typically advanced along with engine speed up to a maximum advance. Thereafter, the spark remains at maximum advance as the throttle is further opened to maximum engine speed.

It is the object of the present invention to provide an improved linkage for coordinating the operation of the spark advance lever and throttle lever in an outboard motor. The linkage of the present invention provides simultaneous operation of the throttle and spark advance lever through a desired portion of the operating range while permitting independent movement of the levers in other operating ranges or conditions. For example, the throttle lever may be opened independently of spark advance lever at high engine speeds. Or the spark advance lever may be advanced independently of the throttle lever to the start position of the engine.

Briefly, the improved linkage of the present invention is suitable for use in a marine drive engine having a throttle valve, a throttle operator with a cam follower for opening and closing the throttle valve, means for altering the ignition timing, and maximum and minimum spark advance stops. The linkage includes a spark advance lever pivotally mounted on the marine drive. The spark advance lever is coupled to the means for altering the ignition timing so that the timing is advanced and retarded responsive to the pivotal movement of the spark advance lever. The spark advance lever has means engaging the maximum and minimum spark advance stops for limiting the pivotal movement of the spark advance lever. A throttle lever is pivotally mounted on the marine drive on the same axis as the spark advance lever. At least one of the spark advance lever and throttle lever has a cam coacting with the cam follower on the throttle operator for opening and closing the throttle valve responsive to pivotal movement of the levers. A resilient means couples the spark advance lever to the throttle lever for obtaining common movement of both levers while permitting independent movement of the throttle lever and spark advance lever, as when the spark advance lever engages one of the stops.

Preferably, the resilient means comprises a coil spring surrounding coaxial portions of one of the throttle lever and spark advance lever. The coil spring has ends engaging radially spaced projections on the spark advance lever and throttle lever to obtain the common movement. The projections are radially aligned when the levers move together. The resiliency of the spring permits independent movement of the levers through a spreading of the ends of the spring as the projections move out of radial alignment.

In another preferred aspect of the present invention, both the spark advance lever and throttle lever have cam surfaces coacting with the throttle operator cam follower so that the operator is operated first by the spark advance lever and then by the throttle lever as the throttle is opened. This permits the spark to be advanced and the throttle opened to a small extent for starting the motor by rotating the spark advance lever without rotating the throttle lever.

The structure of the present invention provides a compact, simple structure when compared to other designs, including those employing a single action spring to obtain the necessary coordination. The structure of the present invention renders the adjustment of the outboard motor control system less critical.

The invention will be further understood by reference to the following detailed description and accompanying drawings.

Figure 1:
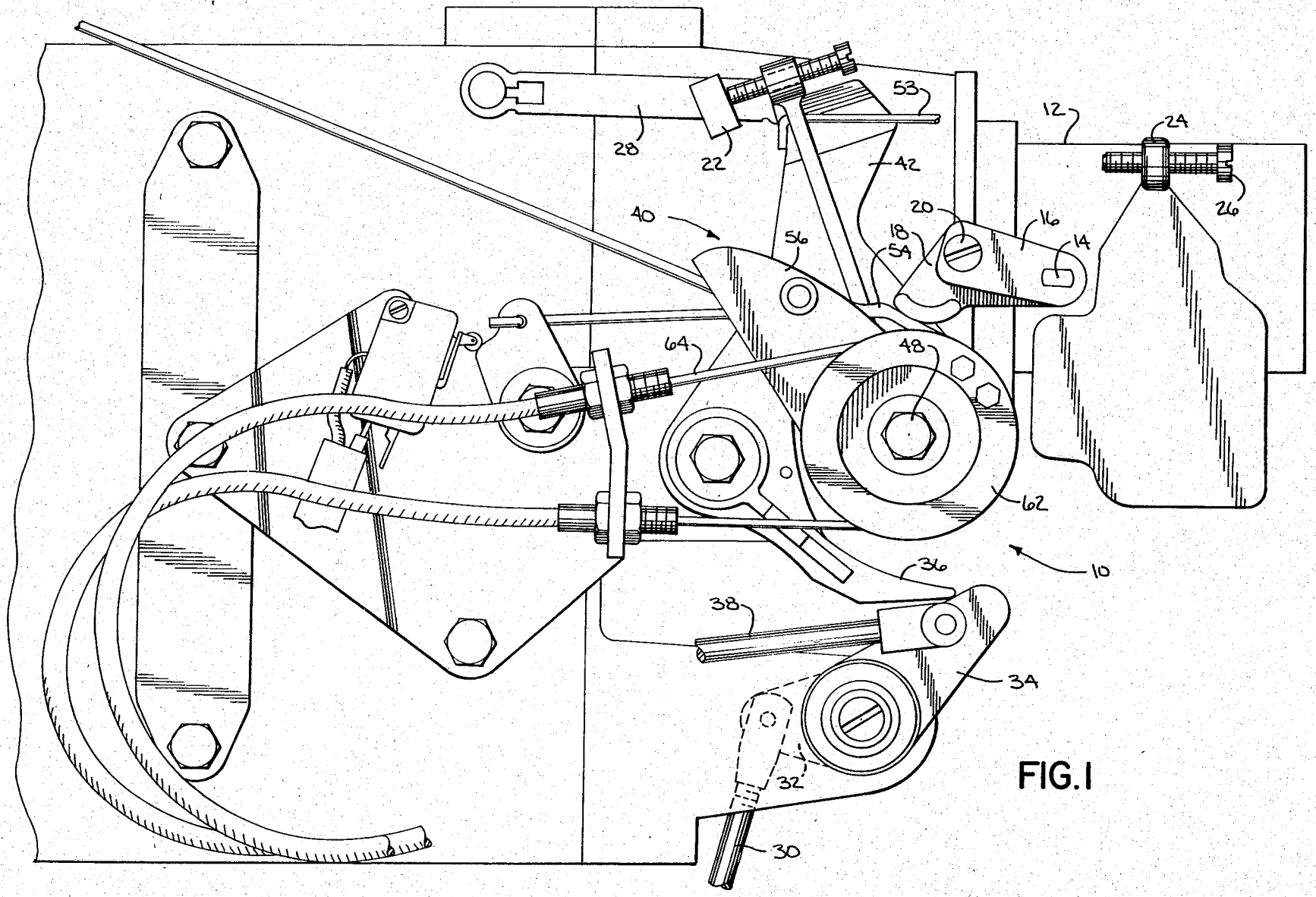
FIG. 1 is a side view of portions of an outboard motor showing the improved throttle-spark advance linkage of the present invention.

In FIG. 1, outboard motor 10 has carburetor 12, the throttle valve of which is connected to shaft 14. Throttle operator 16 is mounted on shaft 14 for rotating same. Throttle operator 16 has an adjustable cam follower 18 secured by screw 20. Outboard motor 10 also has spark advance stops 22 and 24. Spark advance stop 22 may comprise an abutment on the housing of outboard motor 10. Spark advance stop 24 includes adjustable stop bolt 26. Control means 28 is connected to the ignition system of outboard motor 10 for altering the ignition timing of the engine responsive to the movement of means 28.

FIG. 1 also shows gear shift shaft 30, gear shift crank 32 and throttle interlock levers 34 and 36. Control rod 38 operates the gear shifting mechanism.

The spark advance and throttle linkage of the present invention is shown generally by the numeral 40. As shown most clearly in FIGS. 2, 3, and 4, spark advance lever 42 has sleeve 44 at the lower end surrounding bushing 46 and bolt 48. The upper end of spark advance lever 42 is connected to ignition timing control means 28 as by a flexible coupling, such as a ball and socket joint. The upper end of spark advance lever 42 also includes bolt 50 that engages spark adjustment stop 22 and abutment 52 that engages spark advance stop bolt 26 of stop 24. The upper end of spark advance lever 42 further includes link 53 connected to a start control of motor 10. As shown most clearly in FIG. 2, the intermediate portion of spark advance lever 42 contains cam 54 coacting with cam follower 18 of throttle operator 16.

Throttle lever 56 has a sleeve 58 surrounding bushing 46 so that the lever 56 is pivotally mounted on the bushing. Lever 56 has a generally arcuate cam face 60 extending from the sleeve 58. Pulley 62 is mounted on the end of throttle lever 56, as shown most clearly in FIG. 4 to receive cable 64 controlled by the operator of the boat. For example, cable 64 may be connected to a twist grip control on the tiller handle of the outboard motor.

Cam follower 18 is sufficiently wide to be able to coact with both cam face 60 of throttle lever 56 and cam 54 of spark advance lever 42.

Figure 2:
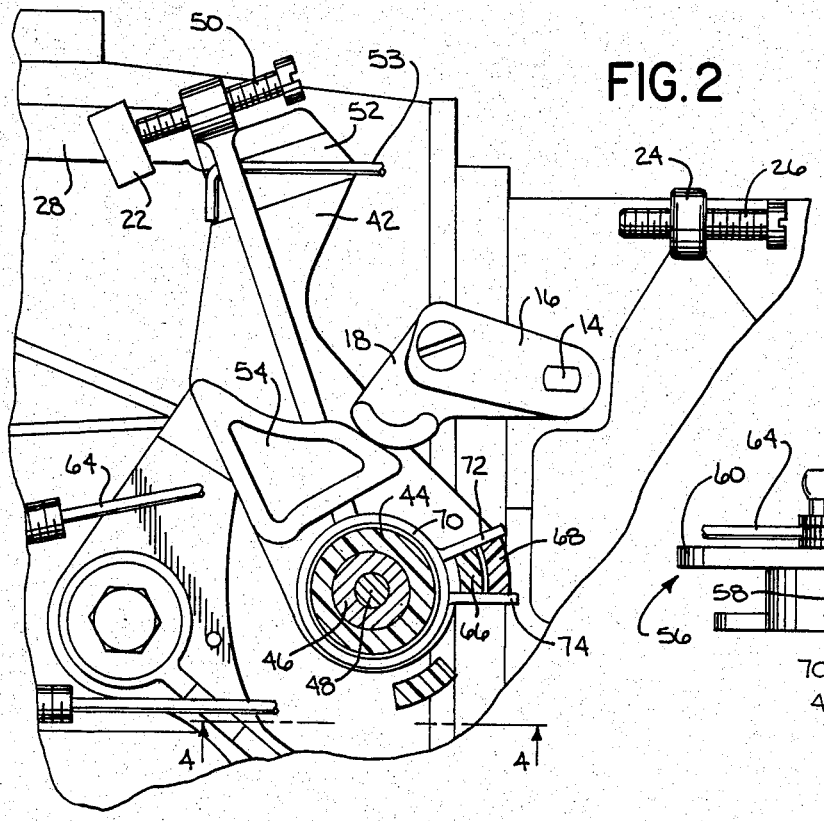
FIG. 2 is a fragmentary side view, similar to FIG. 1, but partially cut away to show additional details of the linkage.
Figure 4:
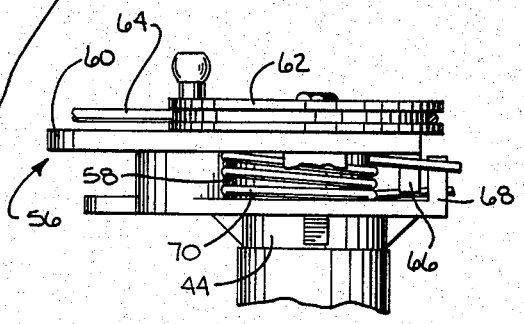
FIG. 4 is a view taken along the line 4—4 of FIG. 2.

As shown in FIGS. 2 and 4, throttle lever 56 includes projection 66 extending parallel to the axis of bolt 48. Spark advance lever 42 includes a similar projection 68. Projection 66 and 68 are radially spaced, as shown in the figures and capable of assuming a position of radial alignment, as shown in FIG. 2. The projections may be generally arcuate in form, subtending the same angle.

Coil spring 70 extends around sleeve 58. The ends 72 and 74 of spring 70 embrace projections 66 and 68, as shown in FIG. 2.

In use, FIGS. 1 and 2 show the linkage in a condition corresponding generally to idle speed of the outboard motor. Spark advance lever 42 engages stop 22 that, along with bolt 50, establishes the most retarded condition of ignition timing. Cam follower 18 of throttle operator 16 rests on cam 54 of spark advance lever 42 to open the throttle valve of carburetor 12 to the idle position.

In the start condition for outboard motor 10, the ignition timing would be advanced to some extent and the throttle valve opened more than the idle condition to insure easy starting of the motor. This is accomplished by rotating spark advance lever 42 to a slight extent in the clockwise direction by start control link 53. The clockwise rotation of spark advance lever 42 advances the timing to the start condition. Cam follower 18 rides up on cam 54 to open the throttle valve of carburetor 12 to the start position. Throttle lever 56 does not rotate since it is held in position by cable 64. However, due to the resiliency of coil spring 70, spark advance lever 42 can rotate independently of throttle lever 56. As projection 68 moves with respect to projection 66 the ends 72 and 74 are spread apart through a partial uncoiling of spring 70.

To increase the speed of outboard motor 10, the operator of the boat operates cable 64 to rotate throttle lever 56 in the clockwise direction. Spring 70 resumes the position shown in FIG. 2. Thereafter spark advance lever 42 rotates with throttle lever 56 since the two levers are carried together as a result of the engagement of projections 66 and 68 between the ends 72 and 74 of coil spring 70.

Throttle lever 56 and spark advance lever 42 pivot in the clockwise direction to continue to open the throttle valve, while at the same time, further advancing the spark. During clockwise rotation of linkage 40, the operation of cam follower 18 transfers from cam 54 on spark advance lever 42 to cam face 60 of throttle lever 56.

Figure 3:
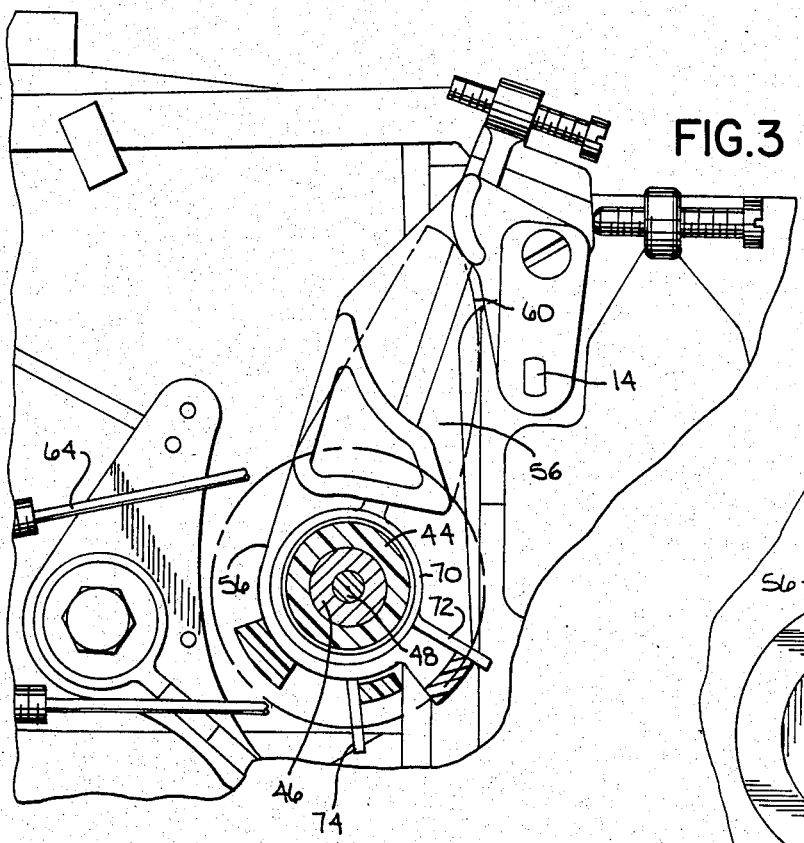
FIG. 3 is a partially cut away side view, similar to FIG. 2, showing the elements of the linkage in a different operating position.
Figure 5:
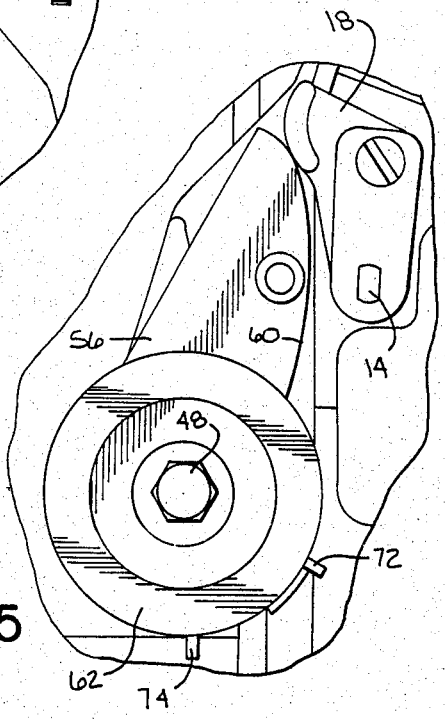
FIG. 5 is a fragmentary view of the elements in the condition shown in FIG. 3 but without any of the elements being cut away.

As the rotation of linkage 40 continues further, a point is reached at which abutment 52 of spark advance lever 42 engages spark advance stop bolt 26, thereby limiting the amount by which the spark may be advanced. However, due to the resiliency of coil spring 70, throttle lever 56 can continue to rotate clockwise to further open the throttle valve of carburetor 12 at full spark advance to the wide open, full speed condition. As projection 66 moves with respect to projection 68, the ends 72 and 74 are spread apart through a partial uncoiling of spring 70. Operation of the motor at full spark advance in this range provides economical operation to the motor. FIGS. 3 and 5 illustrate the condition of linkage 40 at the wide open throttle valve condition.

During closing of the throttle, the above described operating sequence of the linkage is reversed. The resiliencey of spring 70 causes throttle lever 56 to move with respect to spark advance lever 42 until the elements resume a condition in which projections 66 and 68 are aligned. Thereafter the levers move together.

Various modes of carrying out the invention are contemplated as being within the scope of the following claims particularly pointing out and distinctly claiming the subject matter which is regarded as the invention.

I claim:

1. In a marine drive engine having a start control, a speed control, a throttle valve, a throttle operator with a cam follower for opening and closing the throttle valve, means for altering the ignition timing of the engine, and maximum and minimum spark advance stops, improved means for coordinating ignition timing and throttle valve position comprising:

a spark advance lever pivotally mounted on the marine drive for movement about an axis, said spark advance lever being coupled to the means for altering the ignition timing for altering same responsive to pivotal movement of said spark advance lever, said spark advance lever having means engaging with the maximum and minimum spark advance stops for limiting the pivotal movement of said spark advance lever, said spark advance lever being coupled to the start control for being moved by the start control;

a throttle lever pivotally mounted on the marine drive on the same axis as said spark advance lever, said throttle lever being coupled to the speed control, at least one of said spark advance lever and throttle lever having cam means coacting with the cam follower of the throttle operator for opening and closing the throttle valve; and resilient means coupling said spark advance lever to said throttle lever for obtaining common movement of said levers while permitting independent movement of one of said levers with respect to the other of said levers when the movement of the other of said levers is restrained, said resilient means permitting the start control to move said spark advance lever when the speed control restrains the movement of said throttle lever.

2. The improved coordinating means according to claim 1 wherein said resilient means is further defined as permitting said throttle lever to move independently of said spark advance lever when said spark advance lever engages one of said stops.

3. The improved coordinating means of claim 1 further defined as means for permitting said throttle lever to move independently of said spark advance lever in either direction of pivotal movement of said throttle lever.

4. In a marine drive engine having a throttle valve, a throttle operator with a cam follower for opening and closing the throttle valve, means for altering the ignition timing of the engine, and maximum and minimum spark advance stops, improved means for coordinating ignition timing and throttle valve position comprising:

a spark advance lever pivotally mounted on the marine drive for movement about an axis, said spark advance lever being coupled to the means for altering the ignition timing for altering same responsive to pivotal movement of said spark advance lever, said spark advance lever having means engaging with the maximum and minimum spark advance stops for limiting the pivotal movement of said spark advance lever;

a throttle lever pivotally mounted on the marine drive on the same axis as said spark advance lever, at least one of said spark advance lever and throttle lever having cam means coacting with the cam follower of the throttle operator for opening and closing the throttle valve; and resilient means coupling said spark advance lever to said throttle lever for obtaining common movement of said levers while permitting independent movement of one of said levers with respect to the other of said levers when the movement of the other of said levers is restrained, said spark advance lever and throttle lever having portions surrounding said axis, said spark advance lever and throttle lever each having a projection on said portions radially spaced from each other, said resilient means comprising a coil spring surrounding said axis and having ends engaging said projections such that said ends move said spark advance lever and throttle lever together until one of said levers is restrained, the resiliency of said spring thereafter permitting independent movement of the other of said levers.

5. The improved coordinating means according to claim 4 wherein said spark advance lever and throttle lever are mounted on a common shaft.

6. In a marine drive engine having a throttle valve, a throttle operator with a cam follower for opening and closing the throttle valve, means for altering the ignition timing of the engine, and maximum and minimum spark advance stops, improved means for coordinating ignition timing and throttle valve position comprising:

a spark advance lever pivotally mounted on the marine drive for movement about an axis, said spark advance lever being coupled to the means for altering the ignition timing for altering same responsive to pivotal movement of said spark advance lever, said spark advance lever having means engaging with the maximum and minimum spark advance stops for limiting the pivotal movement of said spark advance lever;

a throttle lever pivotally mounted on the marine drive on the same axis as said spark advance lever, each of said spark advance lever and throttle lever having cam means coacting with the cam follower of the throttle operator for opening and closing the throttle valve; and resilient means coupling said spark advance lever to said throttle lever for obtaining common movement of said levers while permitting independent movement of one of said levers with respect to the other of said levers when the movement of the other of said levers is restrained.

7. The improved coordinating means according to claim 6 wherein said spark advance lever and throttle lever are so formed that the throttle operator cam follower initially engages a cam on said spark advance lever as said spark advance lever and throttle lever pivot in one direction and thereafter engages a cam on said throttle lever.

* * * * *